US006130594A

United States Patent [19]

Morant et al.

[11] Patent Number: 6,130,594

[45] Date of Patent: Oct. 10, 2000

[54] MAGNETICALLY DRIVEN ELECTRIC SWITCH

[75] Inventors: Michael Morant, Magnee; Marc Bonjean, Liege; Denis Wysota, Neupre, all of Belgium

[73] Assignee: E.I.B. S.A., Dison, Belgium

[21] Appl. No.: 09/180,748

[22] PCT Filed: May 10, 1997

[86] PCT No.: PCT/EP97/02404

§ 371 Date: May 28, 1999

§ 102(e) Date: May 28, 1999

[87] PCT Pub. No.: WO97/44802

PCT Pub. Date: Nov. 27, 1997

[30] Foreign Application Priority Data

May 17, 1996 [DE] Germany ..... 196 19 835

[51] Int. Cl.[7] ..... H01H 3/00; H01H 51/27; H01F 7/124

[52] U.S. Cl. ..... 335/230; 218/154; 335/79; 335/234

[58] Field of Search ..... 218/7, 14, 78, 218/84, 120, 140, 153, 154; 335/209, 219, 220, 229, 230, 256, 266, 302, 306, 231–236, 132–136, 120–126, 10, 12

[56] References Cited

U.S. PATENT DOCUMENTS

| | | | |
|---|---|---|---|
| 4,253,493 | 3/1981 | English | 335/266 X |
| 4,550,302 | 10/1985 | Watanabe et al. | 335/228 |
| 4,559,511 | 12/1985 | Basnett et al. | 335/281 |
| 4,751,487 | 6/1988 | Green, Jr. | 335/234 |
| 5,034,714 | 7/1991 | Bratkowski et al. | 335/234 |
| 5,200,727 | 4/1993 | Katoh et al. | 335/266 X |
| 5,912,604 | 6/1999 | Harvey et al. | 335/9 |

FOREIGN PATENT DOCUMENTS

4304921C1 8/1994 Germany .

*Primary Examiner*—J. R. Scott
*Attorney, Agent, or Firm*—Jones, Tullar & Cooper, P.C.

[57] ABSTRACT

The present invention relates to a switch with a magnetic drive having an armature movable linearly between two end positions and connected to at least one switch contact, which is under the influence of magnetically generated forces in the end positions. The armature and a ferromagnetic element or shunt are arranged one behind the other in a space between a first and second stop. The stops are pole faces of magnetic circuits with a permanent magnet which exerts a force retaining the armature, movable toward the first stop by the force of an electromagnet, in the first stable end position when the shunt is in its end position at the second stop. Through the application of the shunt to the armature, the force exerted on the armature by the permanent magnet is reversed and transferred to the shunt, so that the shunt is moved to the second stop and the armature to the second stable end position on the shunt and held there by the force of the permanent magnet.

8 Claims, 4 Drawing Sheets

MAGNETICALLY DRIVEN ELECTRIC SWITCH

BACKGROUND OF THE INVENTION

1. Field of the Invention

The present invention relates to a switch with a magnetic drive having an armature which can be displaced between two end positions and is connected with a least one movable switch contact, and which in the end positions is under the influence of magnetically generated forces.

2. Description of Related Art

Here, switch is understood to be a device which switches on nominal currents or excess currents under certain conditions, resists the nominal or excess currents and interrupts them, as well as insulates electrical circuits from each other. To this end a switch has two stable states (states of rest requiring holding forces). In the open state the switch is capable of maintaining the electrical insulation of the circuits. In the closed state the switch is capable of resisting the defined nominal current permanently and an excess current for a defined amount of time.

The switch furthermore has two transition stages in which energy is supplied to a movable switching element. The transition into the closed state is intended to close a circuit and turn on a current. The transition into the open state is intended to interrupt a current. The main components of such a switch are: connecting terminals, switch chamber, quiescent current or operating current contacts, a drive mechanism for actuating the movable switching contacts, and a housing in which the above described elements are arranged and which insulates the circuits. Switches of this type are also known by the name power circuit breakers.

An electrical switch of the type described at the outset is known (DE 43 04 921 C1). The armature of this switch is made of laminated soft iron sheets and is axially displaceably arranged in a chamber surrounded by a rectangular yoke made of laminated soft iron sheets between two permanent magnets, whose like poles face the armature. The permanent magnets are respectively stationarily attached between the armature and a pole piece which makes a transition into the yoke. A coil is respectively arranged inside the yoke on both sides of the pole pieces.

BRIEF SUMMARY OF THE INVENTION

The present invention has as an object to provide a switch with a magnetic drive wherein magnetically generated forces maintain the armature and the movable elements connected with it stably in the respective end position, and wherein an armature movement, once it has been started, dependably changes the armature and the elements connected with it from the one stable end state into the other.

In connection with a switch of the type described at this outset, the object is attained in that the armature and a ferro-magnetic bypass element are arranged linearly movable one behind the other in a space between a first and a second detent, that the detents are pole faces of magnetic circuits containing at least one permanent magnet which exerts a force on the armature, which is displaceable by the force of an electromagnet in the direction toward the first detent, which maintains the armature in the first stable end position against the first detent when the bypass element is arranged in its end position against the second detent, and that by means of the placement of the bypass element against the armature, the force exerted by the permanent magnet on the armature is transferred, possibly by means of a force exerted from the outside on the armature, is reversed in its direction and transferred to the bypass element, because of which the bypass element is displaced as far as the second detent and the armature as far as its second stable end position and maintained therein.

With this drive, the armature has only two stable positions, in one of which it rests against the first detent and in the other against the bypass element, which in turn rests against the second detent in the second stable end position of the armature. In this way having the armature driving the movable contact becoming hung up in an intermediate position between the two end positions is preventable. Once the switching of the armature position has been initiated by switching on the electromagnet, or by the bypass element being placed against the armature, switching is performed automatically and rapidly.

The energy required for moving the bypass element is small, since the movable contact is not fastened on the bypass element.

The switch is preferably closed in the first end position of the armature and open in the second end position of the armature. In this case opening the switch little energy. In connection with a preferred exemplary embodiment, the magnetic circuit comprises a first pair of permanent magnets, arranged on the sides of the chamber at the same level and facing the armature with the same poles, wherein a second pair of permanent magnets is arranged on the side of the chamber at a distance from the first pair and faces with like poles the bypass element, when the latter rests against the second detent. The second pair of permanent magnets maintains the bypass element in its end position against the second detent when the armature has taken up its first end position against the first detent, i.e. no outside force is necessary for maintaining the closed position of the switch. Also, in the open position, in which the force of the first pair of permanent magnets pushes the armature against the bypass element and the latter against the second armature, no outside force is required for maintaining the closed position.

It is useful if a spring force acts on the bypass element in the direction of the armature, which is opposed by the force of the second pair of permanent magnets with an excess which pushes the bypass element against the second detent, wherein the force of the second pair of permanent magnets can be canceled by the force of a second electromagnet. The second electromagnet is switched on for opening, i.e. switching off, the switch, because of which the bypass element is displaced to the armature by the spring.

When the bypass element rests against the armature, the force acting on the armature is suddenly reversed in direction and moves the armature and the bypass element into the second end position. Therefore the second pair of permanent magnets generates a detaining force for the bypass element.

In a further useful embodiment, the armature has a front facing the bypass element and tapering toward the outside, which corresponds with a recess in the bypass element which tapers toward the inside. It is assured with this embodiment that only a very small air gap exists between the contact surfaces of the armature and the bypass element, which are significant for the closing of the lines of magnetic flux over the ferromagnetic elements.

An advantageous embodiment consists in that the permanent magnets of the first pair are arranged on or in pole pieces, and that between the sides of the pole pieces protruding from the yoke and the level of the first detent the coil of the first electromagnet, and between the oppositely located sides of the pole pieces, which protrude from the yoke, and the level of the second detent a recess, whose extension in the direction of the armature movement is less than the length of the bypass element, and a section matched to the contour of the bypass element, in whose walls the second pair of permanent magnets is arranged, as well as the coil of the second electromagnet follow each other. This device is distinguished by its compact structure.

The magnetic circuits contain in particular a rectangular yoke of laminated soft iron sheets with the pole pieces and the contact surfaces, which protrude into the interior of a recess in the yoke and laterally limit the movement range of the armature and the bypass element. The armature and the bypass element are also preferably made of laminated soft iron sheets.

The movable armature contains passages in which bolts are arranged, which connect the armature to a drive rod passing through the magnetic circuit. Guidance of the drive rod takes place via movable elements fastened on the yoke. This drive rod is used as a guide for the bypass element and on one end actuates the damping system during opening; the other end is connected with a lever driving a linkage of bars with which at least one movable switching contact of a medium voltage power switch is connected.

The present invention will be described in greater detail below by means of an exemplary embodiment represented in the drawings, from which ensue further details, characteristics and advantages.

DETAILED DESCRIPTION OF THE INVENTION

Figure 1:
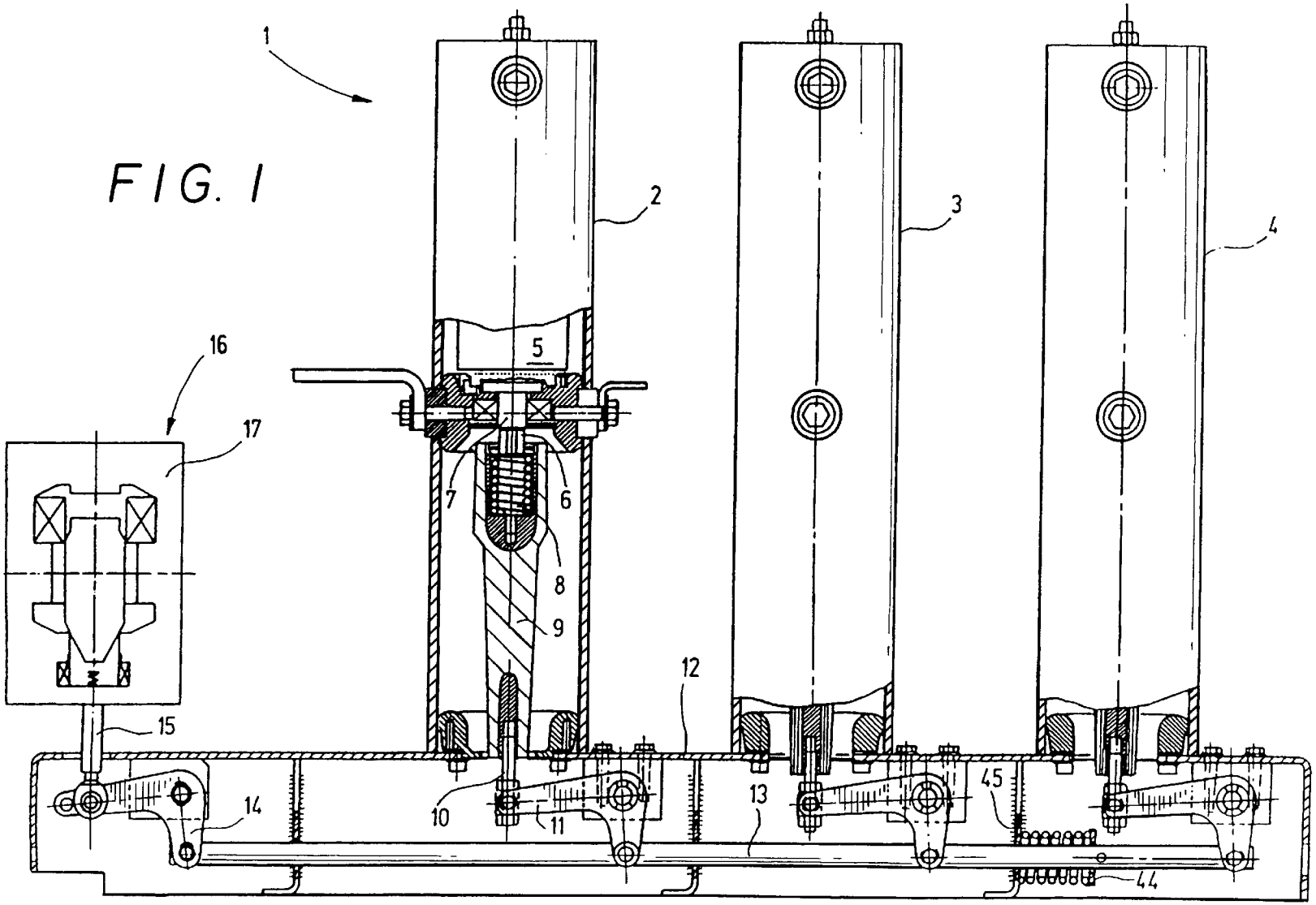
FIG. 1, is a lateral view, partially in section, of a medium voltage or high voltage power circuit breaker with a linear magnetic drive, in accordance with the present invention.

A medium or high voltage power circuit breaker 1 contains three switch poles 2, 3, 4, each of which has a switch chamber 5, in which a stationary switch contact, not shown in greater detail, and a movable switch contact, also not shown in detail, are situated. The switch chamber 5, for example a vacuum switch chamber, is of conventional construction. The movable switch contact is connected with a shank 7, which is seated, longitudinally displaceable, under prestress by a spring 8 against a shaft 6. In the switched-on, or respectively closed position of the power circuit breaker, the springs 8 of the switch poles 2, 3, 4 are tensed, i.e. the springs 8 are released when the power switch 1 is opened. The shaft 6 is rigidly connected with a rod 9 which is hinged, for example by means of a bolt 10, on the one end of a pivotably mounted toggle lever 11, whose other end is hinged on a rod 13, which can be displaced in a housing 12 at right angles in relation to the rod 9. The housing 12 supports the switch poles 2, 3, 4, which are arranged in a row.

One end of a further toggle lever 14 pivotably mounted in the housing 12 is hinged to one end of the rod 13, and its other end is hinged to a rod 15, whose other end is connected to a linear magnetic drive 16.

Figure 2:
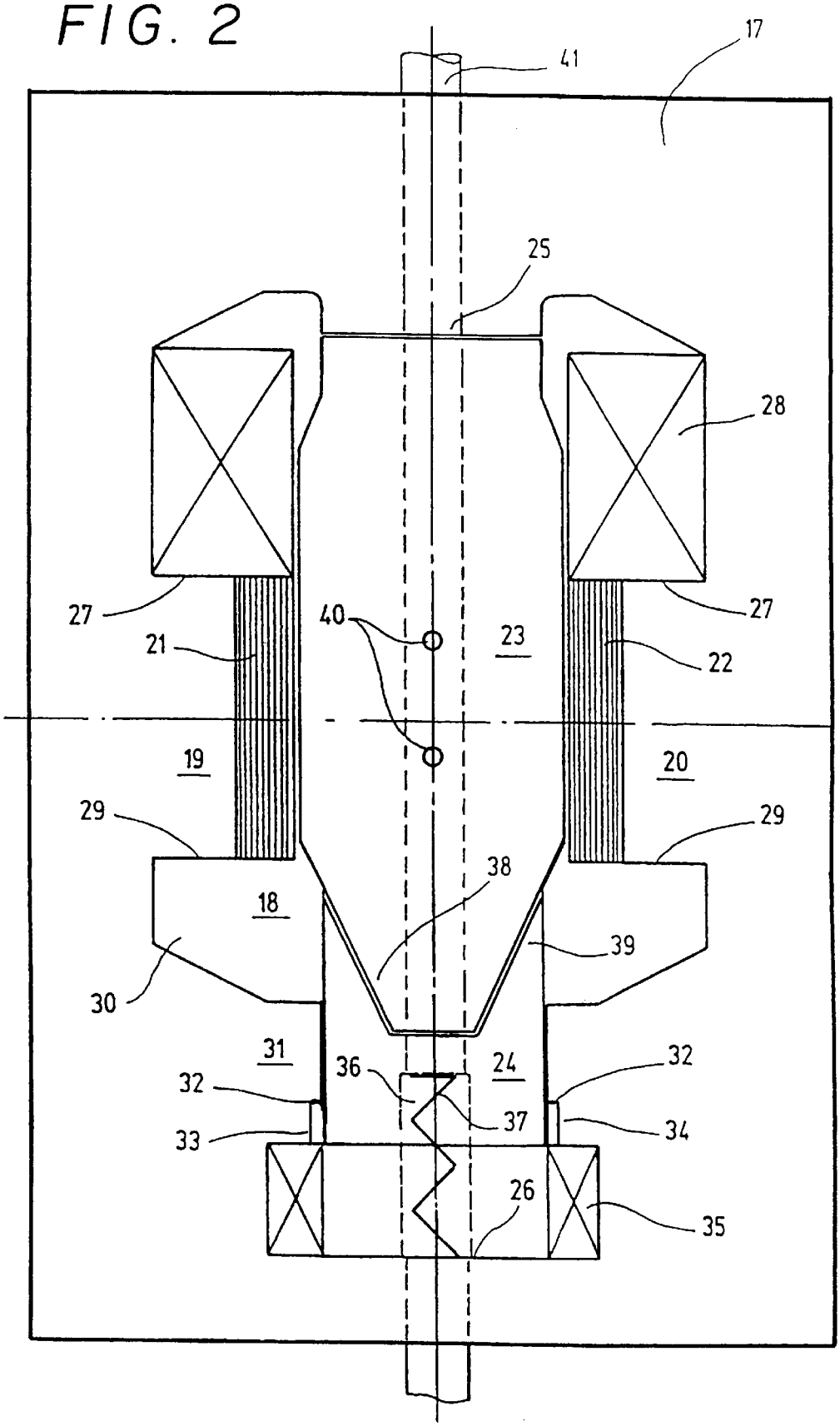
FIG. 2, is a schematic lateral view of the linear magnetic drive of the power circuit breaker in FIG. 1.

The linear magnetic drive 16, which is shown in detail in FIG. 2, has a yoke 17, rectangular on the outside, made of laminated soft iron sheets. On two oppositely situated sides of the yoke 17, pole pieces 19, 20 project from the yoke 17 inward into a chamber 18 recessed in the interior of the yoke 17, on each of whose ends a permanent magnet 21, 22 is fastened. The permanent magnets 21, 22 constitute a first pair of permanent magnets, who face each other with like poles.

An armature 23 and a magnetic bypass element 24 are arranged linearly movable in the chamber 18 in the interior of the yoke 17. The armature 23 and the bypass element 24 respectively are made of laminated iron sheets and are not interlockingly fastened to each other. The displacement travel of the armature 23 and the bypass element 24 are limited at one end by a first detent 25 and at the other end by a second detent 26. The detents 25, 26 are embodied as flat surfaces of the yoke 17. On the sides, the movement space of the armature 23 is limited by the permanent magnets 21, 22. Between the walls 27, which protrude from the yoke 17 on one side of the pole pieces 19, 20, and the one end of the movement space 18, the coil of an electromagnet 28 is arranged, whose coil encloses the one section of the space 18 which adjoins the detent 25.

A free space section 30, in which the armature 23 and the bypass body 24 are displaceable in their axial directions, follows the other sides 29 of the pole pieces 21, 22 protruding from the yoke 17. The free space 30 is limited on the side facing the detent 26 by a protruding section 31, which surrounds a movement space section with an even cross section adapted to the contour of the bypass element 24. The section 31 is not longer than the bypass element 24 and has a cross section which is less than the contour of the armature 24.

A second pair of permanent magnets 33, 34 of smaller dimensions than the permanent magnets 21, 22 and which therefore also generate lesser force, are located in recesses 32 in the inner wall of the section 31. The coil of a second electromagnet 35 is arranged in a recess of the yoke 17 between the permanent magnets 33, 34 and the detent 26. The lines of flux of the first and second electromagnets 28, 35 partially extend in the yoke 17.

The bypass element 24 has a blind bore 36 facing the detent 26, into which a spring 37 projects, whose one end rests against the bottom of the blind bore 36 and whose other end is fastened on the detent 26. The spring 37 exerts a force on the bypass element 24 in the direction toward the armature 23. The front of the armature 23 facing the bypass element 24 tapers wedge-like in the direction toward the bypass element 24, which has a recess 39 matched to the wedge shape.

The magnetic circuit is designed in such a way that, depending on whether the armature and the bypass element are separated from each other or touch, the lines of force of the permanent magnets 21, 22 mainly close over the part of the yoke 17 which has the detent 25, or the part of the yoke 17 which has the section 31, or respectively the detent 26. This means that the force extending from the permanent magnets is directed in the first case to the detent 25, and in the second case against the bypass element 24.

Therefore the size of the armature and the bypass element in the direction of movement, and the distance between the detent 25, 26 are of such a size that, when the armature 23 rests against the detent 25 and the bypass element 24 rests against the former, a magnetic circuit is closed over it and the section 31, whose resistance to the magnetic field is less than the magnetic ciruit extending over the detent 25. Because of this a force is generated, which is directed against the bypass element 24 and moves the armature 23 and the bypass element 24 in the direction toward the detent 26 until the bypass element 24 rests against the detent 26.

The armature 23 contains two passages 40 arranged one behind the other in the longitudinal direction, into which bolts, not shown in detail, have been inserted, by means of which the armature is fastened to a shaft 15 extending through the yoke, the bypass element and the armature.

Figure 3C:
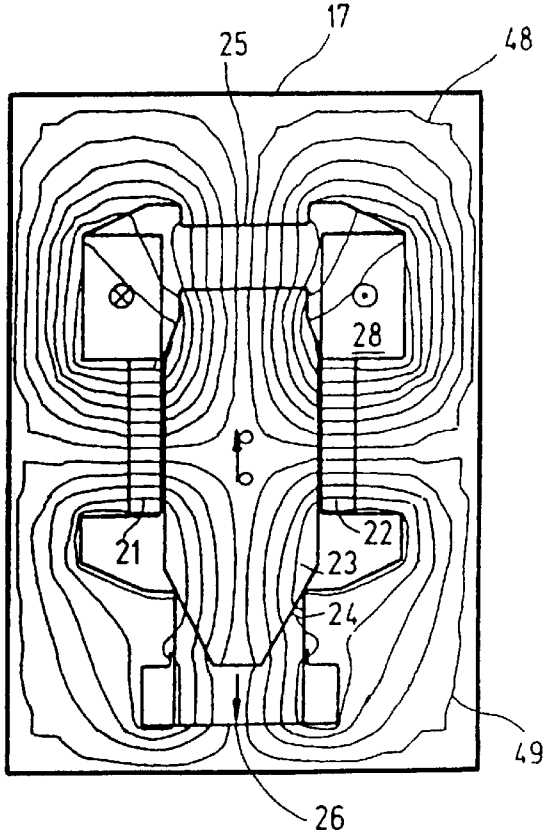
FIG. 3*c*, is a schematic lateral view of the magnetic drive shown in FIG. 2 with lines of magnetic flux at the start of the movement into the closed position of the power circuit breaker.
Figure 3B:
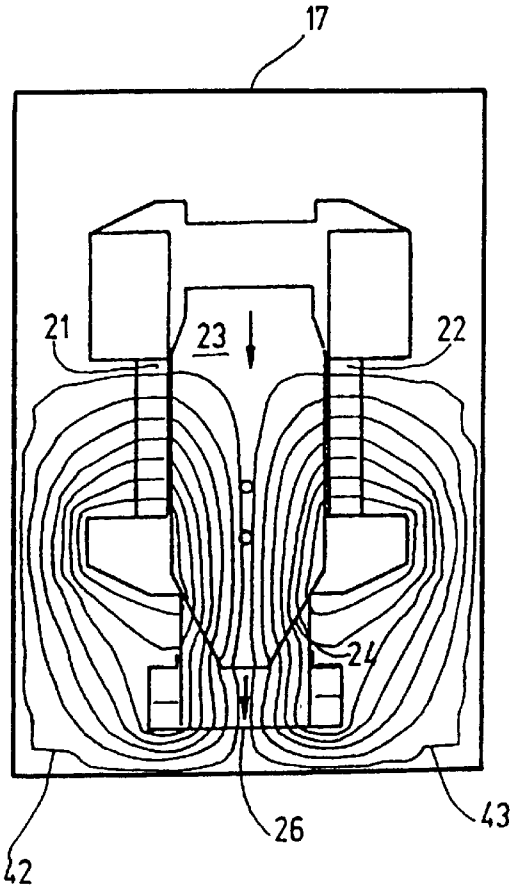
FIG. 3*a*, is a schematic lateral view of the magnetic drive shown in FIG. 2 with lines of magnetic flux in the open position of the power circuit breaker in a schematic lateral view, FIG. 3*b*, the magnetic drive in FIG. 2 with lines of magnetic flux in the closed position of the power circuit breaker.
FIG. 3*d*, is a schematic lateral view of the magnetic drive shown in FIG. 2 with lines of magnetic flux at the start of the movement into the open position of the power circuit breaker.
Figure 3A:
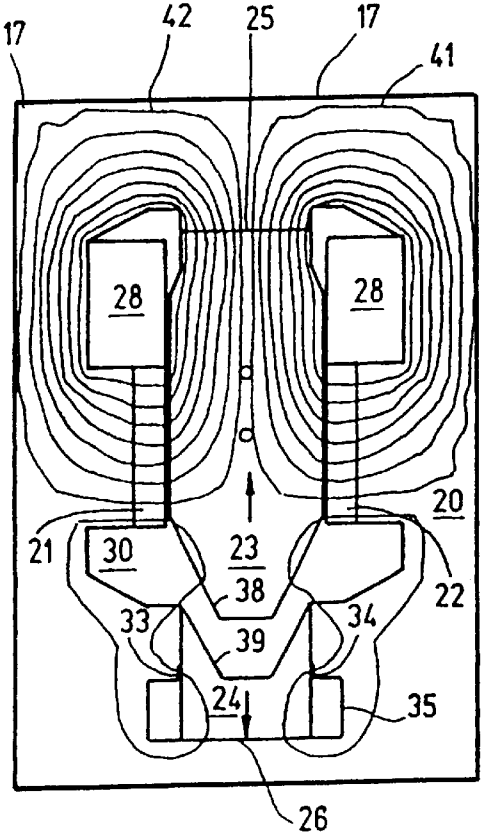

FIG. 3*a* shows the armature 23 in its stable end position, in which it rests against the detent 25 and wherein simultaneously the bypass element 24 rests against the detent 26. A space therefore exists between the bypass element 24 and the armature 23. The magnetic lines of flux extending from the permanent magnets 21, 22 mainly extend through the armature 23. To make this clear, the lines of flux identified by 41, 42, as well as further, not identified lines of flux, are represented in FIG. 3*a*. The lines of flux 41, 42 enter the yoke 17 through the small air gap between the armature 23 and the detent 25 and close inside the permanent magnets 21, 22. Therefore the armature 23 is pushed by a force against the detent 25. The permanent magnets 33, 34 maintain the bypass element 24 in its lower end position, since the lines of magnetic flux from the permanent magnets 33, 34 enter the yoke 17 from the bypass element 24 via the air gap between the bypass element 24 and the detent 26. The bypass element 24 is pushed against the detent 26 by the magnetic force. For this reason the field strength of the permanent magnets 33, 34 has been set in such a way, that the force extending from the permanent magnets 33, 34 exceeds the spring force acting on the bypass element 24. The armature position represented in FIG. 3*a* corresponds to the closed position of the power switch 1.

The armature 23 is represented in its second stable end position in FIG. 3*b*, in which the bypass element 24 rests against the armature 23. The magnetic lines of flux extending from the permanent magnets 21, 22 are almost completely closed over the circuit in which the armature 23, the bypass element 24 and the air gap between the detent 26 and the bypass element 24 are located. For clarification, the lines of flux 42, 43 are represented in FIG. 3*b*. A force is therefore exerted on the armature 23 and the bypass element 24, which pushes the armature 23 against the bypass element 24 and the latter against the detent 26. The armature position represented in FIG. 3*b* corresponds to the open position of the power switch 1. The force extending from the permanent magnets 21, 22 on the armature 23 and the bypass element 24 is considerably greater than the force of the spring 37, so that the armature remains stably in its end position.

Figure 3D:
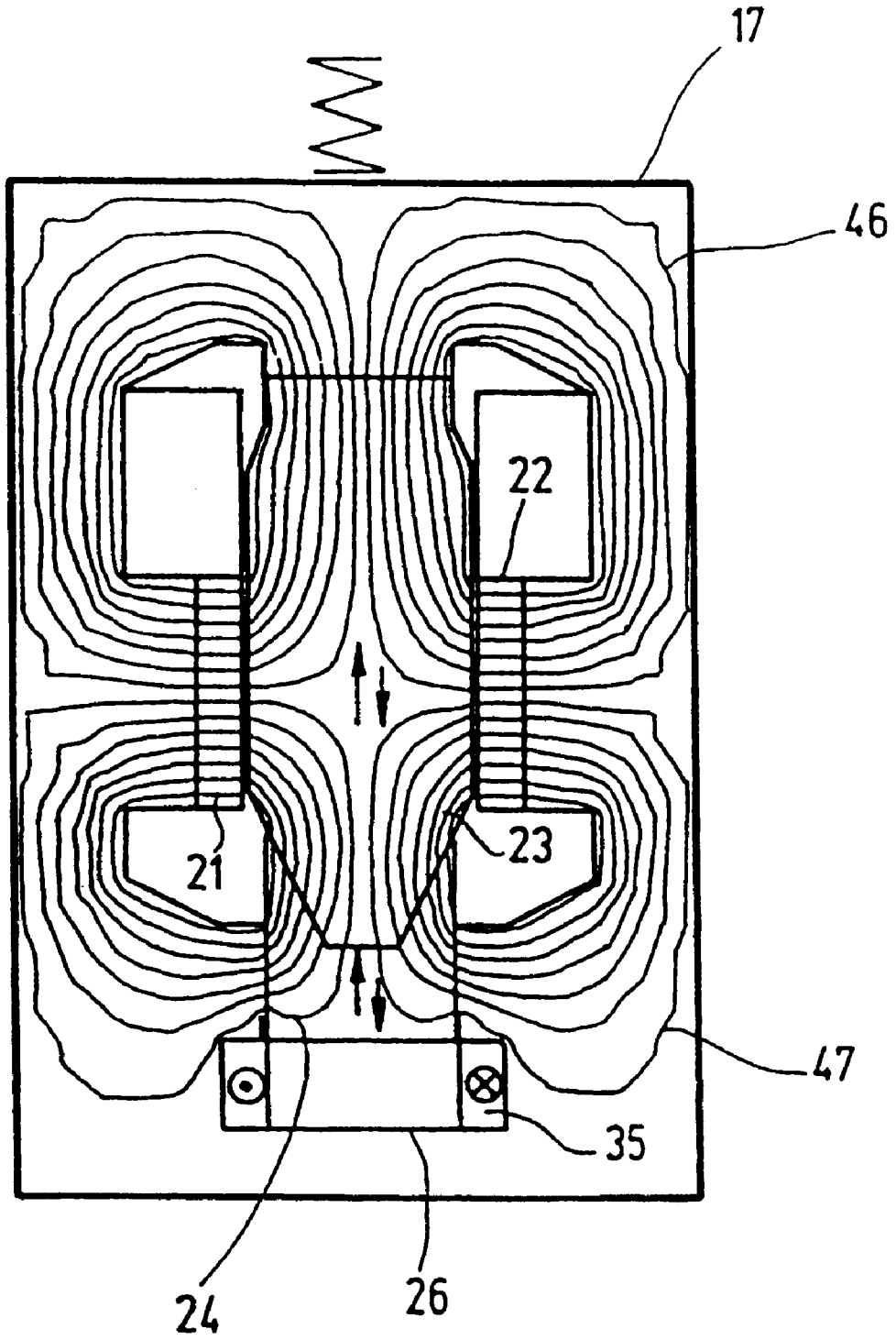

To bring the switch 1 from the closed position into the open position, the electromagnet 35 is provided with voltage. By means of this a force is exerted on the bypass element 24, which at least cancels the force generated by the permanent magnets 33, 34. Therefore the spring 37 pushes the bypass element 24 out of its lower end position against the armature 23, which is in its end position determined by the detent 25. This position of the armature 23 and the bypass element 24 is represented in FIG. 3*d*. When the bypass element 24 touches the armature 23, a magnetic circuit is closed via the bypass element 24 and the section 31 for the magnetic field generated by the permanent magnets 21, 22, wherein the circuit is parallel with the circuit extending over the detent 25. The magnetic resistance is equal to or less than the last mentioned circuit. Therefore the force acting between the armature 23 and the detent 25 is at least cancelled, or is partially converted into a force acting in the opposite direction. This means that, because of the relaxation of the spring 8 and of a switch-off-spring 44 acting on the rod 13 and supported on the latter as well as on a wall 45 in the housing 12, the armature 23 and the bypass element 24 are moved in the direction toward the detent 26. The change in the course of the lines of flux is represented in FIG. 3*d* by the lines of flux identified by 46 and 47, which respectively extend in one of the parallel magnetic circuits.

The armature 23 and the bypass element 24 move until the bypass element 24 touches the detent 26. The state represented in FIG. 3 then occurs. The opening of the switch contacts, or respectively turning the switch 1 off, can be triggered with little output of energy, since only the bypass element 24 needs to be moved to the armature 23. The switching speed is determined by the energy stored in the springs 8 and 44.

To bring the switch 1 from the opening position into the closed position, the electromagnet 28 is provided with voltage. The electromagnet 28 is designed in such a way that it generates a very strong magnetic field, which provides a force on the armature acting in the direction toward the detent 25. FIG. 3*c* represents the course of the lines of flux at the time the electromagnet 28 is switched on. Only the lines of flux 48, 49 are identified in FIG. 3*c* for clarification, of which the line of flux 48 extends in the magnetic circuit containing the detent 25. The line of flux 49 extends in the circuit containing a portion of the armature 23, the bypass element 24 and the detent 26.

The energy for the generation of a very strong magnetic field is also provided by the discharge of a capacitor through the coil of the electromagnet 28. This capacitor is not shown in greater detail. The strong magnetic field generates a strong force acting on the armature 23, by means of which the armature 23 is rapidly moved in the direction toward the detent 25. In the process, the switch contacts of the switch 7 are closed and the springs 8 and 44 are tensed. When the armature 23 has reached the detent 25, the state represented in FIG. 3*a* occurs.

A number of advantages can be achieved with the above described switch drive.

One advantage lies in that the opening energy is low, since the current flowing in the coil only needs to prevent the flux extending from the second pair of permanent magnets. As soon as the force exerted on the bypass element 24 is less than the force of the spring 37, the bypass element 24 moves away from the yoke 17. The opening process, i.e. the opening speed of the switch contacts, is independent of the energy stored in the spring 37, i.e. the opening speed corresponds to one of: power circuit breakers, or respectively power switches known per se. There is no stable intermediate position between the two end positions of the armature 23, i.e. a switching process, once initiated, always results in opening or closing of the switch 1.

What is claimed is:

1. A switch with a magnetic drive, said magnetic drive including:

an armature linearly displaced between two end positions, at each end position said armature being acted upon by a magnetic force;

a ferro-magnetic bypass element;

means defining a space and a first and second detent, said armature and said ferro-magnetic bypass element being arranged one behind the other in said space between said first and second detent, said first and second detents serving as pole faces of magnetic circuits;

at least one permanent magnet forming part of the magnetic circuits; and an electromagnet forming part of the magnetic circuits, wherein:

said two end positions define a first stable end position and a second stable end position of said armature;

said electromagnet exerting a force against said armature which force is directed in the direction of said first detent, said armature being maintained in said first stable end position by the force of said electromagnet when said bypass element is arranged against said second detent; and said permanent magnet exerting a force against said armature which force is directed in the direction of said second detent, said armature being maintained in said second stable end position by the force of said permanent magnet when said bypass element is engaged by said armature and is arranged against said second detent.

2. The switch as defined in claim 1, wherein said switch is closed when said armature is maintained in said first stable and position, and is open when said armature is maintained in said second stable end position.

3. The switch as defined in claim 1, wherein a first pair of permanent magnets are provided, with said first pair of permanent magnets being arranged along said space facing said armature, and with said second pair of permanent magnets being arranged along said space facing said bypass element when said bypass element engages said second detent.

4. The switch as defined in claim 3, further including:

a spring which exerts a spring force against said bypass element in the direction of said armature; and a second electromagnet, wherein:

said spring force is opposed by the force from said second pair of permanent magnets;

said bypass element biased against said second detent by a force derived as the difference between said spring force and the force from said second pair of permanent magnets; and the force from said second pair of permanent magnets is adapted to be canceled by the force of said second electromagnet.

5. The switch as defined in claim 1, wherein:

said armature has a front part tapering outwardly when viewed toward said first detent, and wherein said bypass element includes a recess which tapers inwardly when viewed toward said second detent, said tapers corresponding to each other.

6. The switch as defined in claim 4, wherein:

said means defining a space and a first and second detent comprises a yoke, said yoke defining a pair of pole pieces, having sides which face said first detent, a recess adjacent to said second detent, and a section which is matched to the outer contour of said bypass element;

the permanent magnets of said first pair of permanent magnets are arranged on said pair of pole pieces;

the coil of said first electromagnet is located between said sides of said pair of pole pieces and said first detent;

said recess has an extent in the direction of movement of said armature which is less than the length of said bypass element; and said second pair of permanent magnets is arranged to follow the coil of said second electromagnet in a wall of said section which is matched to the outer contour of said bypass element.

7. The switch as defined in claim 6, wherein:

said yoke is rectangular and comprises laminated, soft iron sheets; and said pole pieces extend into said space and laterally limit the movement range of said armature and said bypass element.

8. The witch as defied in claim 1, further including:

a drive rod, wherein:

said armature has passages for fastening to said drive rod, by means of which drive energy is transmitted to movable switch contacts.

* * * * *